US010622704B2

(12) United States Patent
Hong et al.

(10) Patent No.: US 10,622,704 B2
(45) Date of Patent: Apr. 14, 2020

(54) EMBEDDED ANTENNA

(71) Applicant: EMW CO., LTD., Incheon (KR)

(72) Inventors: Chang Ho Hong, Seoul (KR); Won Mo Seong, Gyeonggi-do (KR)

(73) Assignee: EMW CO., LTD., Incheon (KR)

( * ) Notice: Subject to any disclaimer, the term of this patent is extended or adjusted under 35 U.S.C. 154(b) by 0 days.

(21) Appl. No.: 15/107,564

(22) PCT Filed: Dec. 22, 2014

(86) PCT No.: PCT/KR2014/012667
§ 371 (c)(1),
(2) Date: Jun. 23, 2016

(87) PCT Pub. No.: WO2015/099388
PCT Pub. Date: Jul. 2, 2015

(65) Prior Publication Data

US 2016/0329627 A1 Nov. 10, 2016

(30) Foreign Application Priority Data

Dec. 23, 2013 (KR) ..... 10-2013-0161479

(51) Int. Cl.

| | |
|---|---|
| ***H01Q 1/24*** | (2006.01) |
| ***H01Q 5/357*** | (2015.01) |
| ***H01Q 5/371*** | (2015.01) |
| ***H01Q 5/364*** | (2015.01) |
| ***H01Q 1/48*** | (2006.01) |

(52) U.S. Cl.
CPC ..... *H01Q 1/243* (2013.01); *H01Q 1/48* (2013.01); *H01Q 5/357* (2015.01); *H01Q 5/364* (2015.01); *H01Q 5/371* (2015.01)

(58) Field of Classification Search
CPC ..... H01Q 1/243; H01Q 1/48; H01Q 5/357; H01Q 5/364; H01Q 5/371
USPC ..... 343/702
See application file for complete search history.

(56) References Cited

U.S. PATENT DOCUMENTS

| | | | | |
|---|---|---|---|---|
| 7,447,530 | B2 * | 11/2008 | Iwai | H01Q 1/24 343/702 |
| 8,471,771 | B2 * | 6/2013 | Su | H01Q 1/243 343/700 MS |
| 8,587,485 | B2 * | 11/2013 | Tahk | H01Q 1/243 343/702 |
| 8,618,989 | B2 * | 12/2013 | Sung | B29C 45/14065 343/702 |
| 8,624,783 | B2 * | 1/2014 | Kim | H01Q 1/243 343/700 MS |
| 8,842,048 | B2 * | 9/2014 | Kim | H01Q 1/243 343/702 |

(Continued)

FOREIGN PATENT DOCUMENTS

| | | |
|---|---|---|
| CN | 102800931 A | 11/2012 |
| CN | 103094717 A | 5/2013 |

(Continued)

*Primary Examiner* — Ab Salam Alkassim, Jr.
(74) *Attorney, Agent, or Firm* — The PL Law Group, PLLC

(57) ABSTRACT

An embedded antenna includes a power transfer pad connected to a circuit inside a portable terminal having a metal exterior, and a first radiation unit which is connected to the power transfer pad so as to radiate a signal of a first passband, and a second radiation unit which is connected to the metal exterior so as to radiate a signal of a second passband.

13 Claims, 6 Drawing Sheets

(56) References Cited

U.S. PATENT DOCUMENTS 8,872,706 B2 * 10/2014 Caballero ..... H01Q 1/243 343/702
9,077,066 B1 * 7/2015 Lee ..... H01Q 9/0407
9,112,271 B2 * 8/2015 Mo ..... H01Q 1/243
9,160,058 B2 * 10/2015 Tsou ..... H01Q 1/2266
9,166,279 B2 * 10/2015 Jin ..... H01Q 1/243
9,306,292 B2 * 4/2016 Ryu ..... H01Q 5/35
9,520,641 B2 * 12/2016 Lin ..... H01Q 1/243
9,564,679 B2 * 2/2017 Rho ..... H01Q 1/46
9,577,331 B2 * 2/2017 Tseng ..... H01Q 1/243
9,728,854 B2 * 8/2017 Kim ..... H01Q 1/243
10,186,758 B2 * 1/2019 Wang ..... H01Q 9/42
10,403,964 B2 * 9/2019 Yoo ..... H01Q 21/28
10,446,915 B2 * 10/2019 Chen ..... H01Q 1/48
2004/0145525 A1 * 7/2004 Annabi ..... H01Q 1/243 343/700 MS
2006/0139219 A1 * 6/2006 Sadamori ..... H01Q 1/243 343/702
2006/0192712 A1 * 8/2006 Park, II ..... H01Q 1/242 343/700 MS
2006/0293078 A1 * 12/2006 Qi ..... H01Q 1/243 455/552.1
2007/0040755 A1 * 2/2007 Na ..... H01Q 1/243 343/702
2007/0063903 A1 * 3/2007 Mun ..... H01Q 1/243 343/702
2008/0129644 A1 * 6/2008 Seo ..... H01Q 1/243 343/893
2008/0165063 A1 * 7/2008 Schlub ..... H01Q 1/243 343/702
2008/0266190 A1 * 10/2008 Ohba ..... H01Q 1/243 343/702
2008/0316115 A1 * 12/2008 Hill ..... H01Q 1/243 343/702
2008/0316116 A1 * 12/2008 Hobson ..... H01Q 1/243 343/702
2008/0316120 A1 * 12/2008 Hirota ..... H01Q 1/2258 343/702
2009/0079639 A1 * 3/2009 Hotta ..... H01Q 1/243 343/702
2009/0115674 A1 * 5/2009 Fujieda ..... H01Q 1/243 343/745
2009/0153407 A1 * 6/2009 Zhang ..... H01Q 1/243 343/702
2010/0053002 A1 * 3/2010 Wojack ..... H01Q 1/243 343/702
2010/0123632 A1 * 5/2010 Hill ..... H01Q 1/243 343/702
2010/0194647 A1 * 8/2010 Man ..... H01Q 1/243 343/702
2011/0215971 A1 * 9/2011 Rao ..... H01Q 1/243 343/702
2012/0088560 A1 * 4/2012 Wehrmann ..... H04B 1/3838 455/575.7
2012/0206302 A1 * 8/2012 Ramachandran ..... H01Q 1/24 343/702
2012/0218151 A1 * 8/2012 Wong ..... H01Q 1/243 343/700 MS
2012/0229347 A1 * 9/2012 Jin ..... H01Q 1/243 343/702
2012/0235866 A1 * 9/2012 Kim ..... H01Q 1/243 343/700 MS
2012/0249393 A1 * 10/2012 Hotta ..... H01Q 1/243 343/843
2012/0262345 A1 * 10/2012 Kim ..... H01Q 1/243 343/702
2012/0268328 A1 * 10/2012 Kim ..... H01Q 1/243 343/702
2013/0069836 A1 * 3/2013 Bungo ..... H01Q 1/243 343/724
2013/0076574 A1 * 3/2013 Rappoport ..... H01Q 1/243 343/702
2013/0088397 A1 * 4/2013 Mo ..... H01Q 1/243 343/702
2013/0154886 A1 * 6/2013 Isohatala ..... H01Q 1/243 343/702
2013/0176181 A1 * 7/2013 Mo ..... H01Q 1/243 343/702
2013/0194143 A1 * 8/2013 Bungo ..... H01Q 21/28 343/725
2013/0203364 A1 * 8/2013 Darnell ..... H01Q 1/243 455/77
2014/0009355 A1 * 1/2014 Samardzija ..... H01Q 1/42 343/789
2014/0078008 A1 * 3/2014 Kang ..... H01Q 5/35 343/702
2014/0210675 A1 * 7/2014 Hwang ..... H01Q 1/44 343/702
2014/0247547 A1 * 9/2014 Jung ..... H01F 27/36 361/679.26
2014/0292584 A1 * 10/2014 Lin ..... H01Q 1/243 343/700 MS
2014/0292590 A1 * 10/2014 Yoo ..... H01Q 1/243 343/702
2015/0138020 A1 * 5/2015 Khobragade ..... H01Q 1/243 343/702
2016/0049720 A1 * 2/2016 Hwang ..... H01Q 1/243 343/702
2016/0087330 A1 * 3/2016 Kato ..... H01Q 1/243 343/702
2016/0118710 A1 * 4/2016 Shin ..... H01Q 1/241 343/702
2016/0197403 A1 * 7/2016 Choi ..... H01Q 1/243 343/700 MS
2016/0294060 A1 * 10/2016 Meng ..... H01Q 1/243
2017/0012347 A1 * 1/2017 Ohguchi ..... H01Q 1/44
2017/0170562 A1 * 6/2017 Lee ..... H01Q 1/243
2017/0207515 A1 * 7/2017 Li ..... H01Q 1/44
2017/0294706 A1 * 10/2017 Koga ..... H01Q 1/24
2017/0338545 A1 * 11/2017 Guo ..... H01Q 1/243
2018/0034135 A1 * 2/2018 Kwak ..... H01Q 5/35
2018/0034148 A1 * 2/2018 Nam ..... H01Q 1/50
2018/0053990 A1 * 2/2018 Caballero ..... H01Q 1/243
2018/0069301 A1 * 3/2018 Choi ..... H01Q 1/243
2018/0248252 A1 * 8/2018 Hu ..... H01Q 1/36
2018/0261921 A1 * 9/2018 Ha ..... H01Q 1/243
2018/0278287 A1 * 9/2018 Nishikawa ..... H01Q 5/321

FOREIGN PATENT DOCUMENTS

KR 10-2004-0071656 A 8/2004
KR 20080058736 A * 6/2008
KR 10-2012-0027985 A 3/2012

* cited by examiner

EMBEDDED ANTENNA

CROSS REFERENCE TO RELATED APPLICATIONS AND CLAIM OF PRIORITY

This application claims benefit under 35 U.S.C. 119(e), 120, 121, or 365(c), and is a National Stage entry from International Application No. PCT/KR2014/012667, filed Dec. 22, 2014, which claims priority to the benefit of Korean Patent Application No 10-2013-0161479 filed in the Korean Intellectual Property Office on Dec. 23, 2013, the entire contents of which are incorporated herein by reference.

TECHNICAL FIELD

The present invention relates to an embedded antenna having a metal exterior.

BACKGROUND ART

Generally, antennas installed in mobile terminals including mobile communication functions may be largely divided into external antennas and embedded antennas according to installation positions.

A whip type antenna, a helical type antenna, and the like are mainly used as an external antenna. The external antenna has a structure which is inserted and removed by a user by being fixedly installed at a side surface or an upper portion of the mobile terminal.

Since the above external antenna is installed outside the mobile terminal, the mobile terminal is difficult to use and keep, and an exterior of the mobile terminal may be damaged. Further, since an installation space for the external antenna should be ensured at the outside of the mobile terminal, there may be a constraint on an exterior design of the mobile terminal, the design may be damaged, and it is difficult to miniaturize and slim the mobile terminal.

In order to compensate for the above-described disadvantages of the external antenna, an embedded antenna method in which an antenna is installed inside a mobile terminal is mainly being used in recent years.

A monopole type antenna, a loop type antenna, or a planar inverted-F antenna (PIFA) is used as the embedded antenna (or an intenna). Since the embedded antenna is installed inside the mobile terminal, a space in which the embedded antenna may be installed should be provided inside the mobile terminal. The installation space of the embedded antenna is reduced as the mobile terminal is slimmed or miniaturized.

Further, recently, as mobile terminals are being slimmed and miniaturized, the number of mobile terminals which have external case formed of a metal material for robustness and elegant design of the mobile terminal is increased.

SUMMARY

Embodiments of the present invention are directed to providing an embedded antenna of which a radiation characteristic is improved using a metal outer edge.

Further, embodiments of the present invention are directed to providing an embedded antenna in which a distance between a radiator and a metal outer edge is increased by installing a ground pad on a metal outer edge and grounding the radiator through a ground pad.

Embodiments of the present invention are directed to providing an embedded antenna in which a hand effect is reduced.

One aspect of the present invention provides an embedded antenna including a power supply pad connected to a circuit inside a mobile terminal having a metal exterior, a first radiator connected to the power supply pad and configured to radiate a signal in a first passband, and a second radiator connected to the metal exterior and configured to radiate a signal in a second passband.

The embedded antenna may further include a matching device connected between the second radiator and the metal exterior.

In the embedded antenna, the metal exterior may be an edge of the mobile terminal.

Another aspect of the present invention provides an embedded antenna including a power supply pad connected to a circuit inside a mobile terminal having a metal exterior, a ground pad formed on the metal exterior, a connection pad connected to the ground pad, and a radiator configured to radiate a signal applied through the power supply pad.

In the embedded antenna, the radiator may be connected to the connection pad and the power supply pad.

In the embedded antenna, the radiator may include a third radiator connected to the power supply pad and configured to radiate a signal in a first passband, and a fourth radiator connected to the connection pad and configured to radiate a signal in the second passband.

The embedded antenna may further include a matching device connected between the connection pad and the ground pad.

According to embodiments of the present invention, as an embedded antenna is grounded using an outer edge having a metal component, the embedded antenna is installed separately from a user's hand, and thus a hand effect can be reduced.

Further, according to the embodiments of the present invention, as a radiator is connected to the outer edge having a metal component, a ground area of the embedded antenna is increased, and thus a radiation characteristic of a service band having a relatively low-frequency band can be improved.

DETAILED DESCRIPTION

Hereinafter, exemplary embodiments of the present invention will be described in detail with reference to the accompanying drawings. However, these embodiments are only examples and the present invention is not limited thereto.

When the present invention is described, if it is determined that detailed descriptions of known technology related to the present invention unnecessarily obscure the subject matter of the invention, detailed descriptions thereof will be omitted. Some terms described below are defined by considering functions in the invention and meanings may vary depending on, for example, a user or operator's intentions or customs. Therefore, the meanings of terms should be interpreted based on the scope throughout this specification.

The spirit and scope of the present invention are defined by the appended claims. The following embodiments are only made to efficiently describe the technological scope of the invention to those skilled in the art.

In the following embodiments of the present invention, a high-frequency band may include a digital cordless system (DCS) (in a range of 1710 MHz to 1880 MHz), personal communication services (PCS) (in a range of 1850 MHz to 1990 MHz), a wideband code division multiple access (WCDMA) (in a range of 1920 MHz to 2170 MHz), and the like, and a low-frequency band may include a global system for mobile telecommunication (GSM) (in a range of 880 MHz to 960 MHz).

Figure 1:
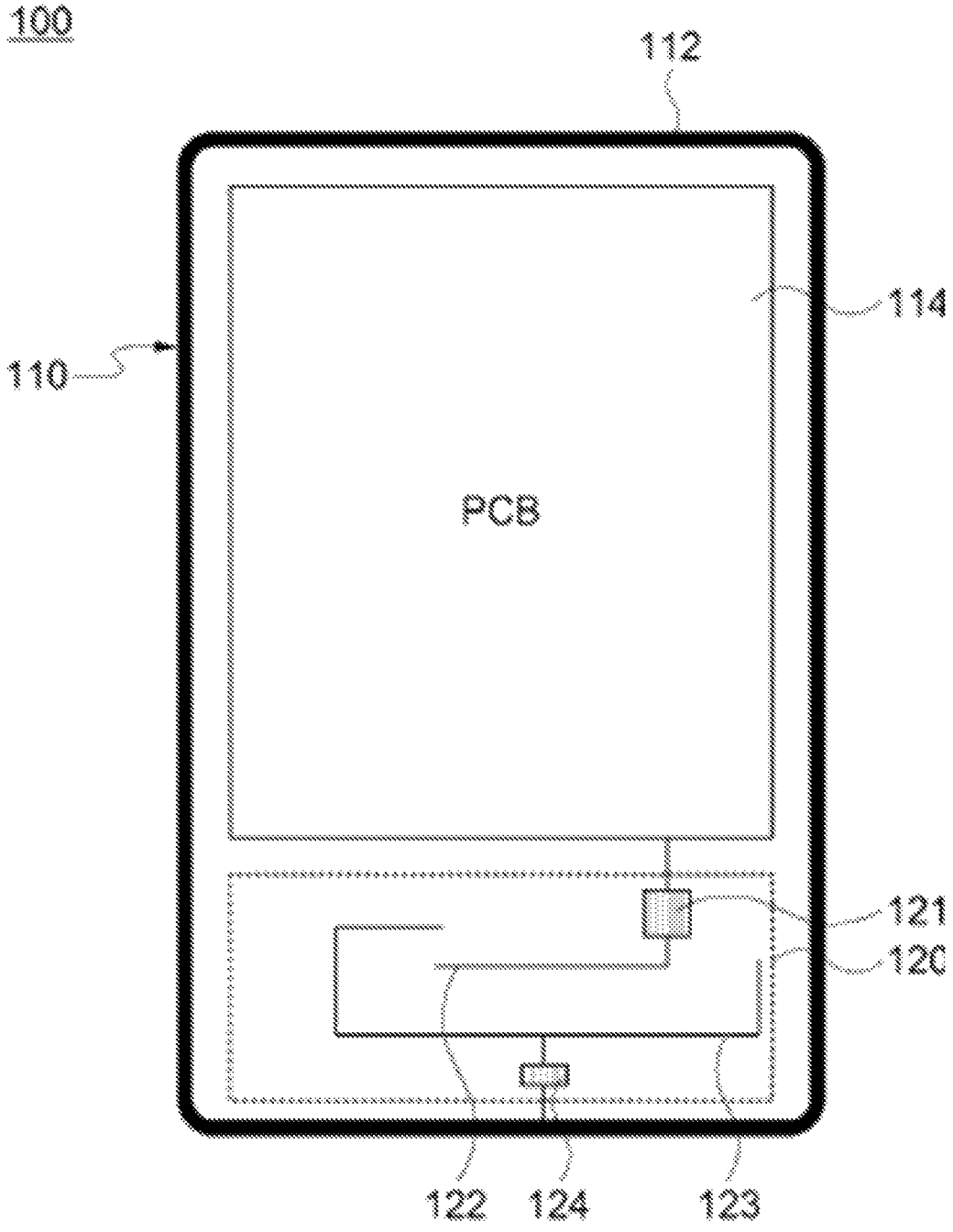
FIG. 1 is a view illustrating a mobile terminal including an embedded antenna according to one embodiment of the present invention.
Figure 2:
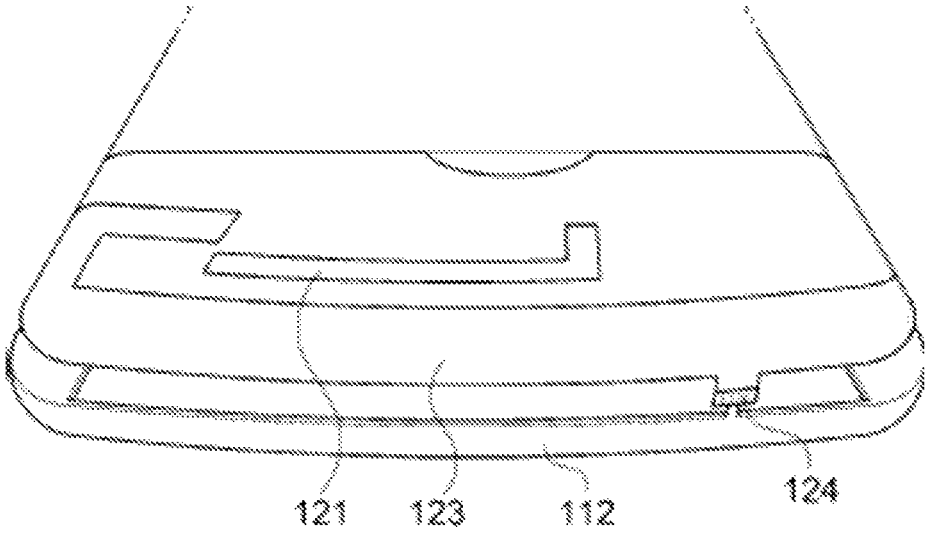
FIG. 2 is a view illustrating an internal structure of a mobile terminal on which an embedded antenna according to one embodiment of the present invention is mounted.

FIG. 1 is a view illustrating a mobile terminal including an embedded antenna according to one embodiment of the present invention, and FIG. 2 is a view illustrating an internal structure of a mobile terminal on which the embedded antenna according to one embodiment of the present invention is mounted.

As illustrated in FIGS. 1 and 2, the mobile terminal 100 includes a main body 110 and an embedded antenna 120 installed in an inner lower portion of the main body 110. Here, the main body 110 includes an outer edge 112 and a printed circuit board (PCB) 114 (hereinafter referred to as a PCB). Specifically, the outer edge 112 of the main body 110 may be formed of a conductive material, for example, a metal material, and the PCB 114 on which various electrical components are mounted is installed inside the main body 110.

Since the outer edge 112 may be electrically connected to the embedded antenna 120 and may perform a ground function of the embedded antenna 120, a ground area thereof is increased, and thus a radiation characteristic of a service band having a relatively low-frequency band such as a GSM frequency band is improved.

The embedded antenna 120 according to one embodiment of the present invention includes a power supply pad 121, a first radiator 122 which radiates a signal in a high-frequency band, a second radiator 123 which radiates a signal in a low-frequency band, and a matching device 124.

The power supply pad 121 electrically connects the PCB 114 of the main body 110 to the embedded antenna 120. Specifically, the power supply pad 121 may be connected to a duplexer (not illustrated) installed on the PCB 114. Further, the power supply pad 121 may be connected to the first radiator 122.

The first radiator 122 may provide a path through which a current supplied from the PCB 114 flows, and may adjust a resonant frequency in a high-frequency band by adjusting a length of the current path, that is, a length of the first radiator 122.

The second radiator 123 may be connected to the outer edge 112 and may process a signal in a low-frequency band. Here, a resonant frequency in the low-frequency band may be adjusted by adjusting a physical length of the second radiator 123.

As described above, as the second radiator 123 is connected to the outer edge 112, the ground area of the embedded antenna 120 is increased, and thus the outer edge 112 may improve a radiation characteristic of a service band having a relatively low-frequency band.

Meanwhile, the matching device 124 may be installed between the second radiator 123 and the outer edge 112. In a predetermined embodiment, the matching device 124 may be a capacitor having capacitance in a range of several pFs to several hundred pFs or an inductor in a range of several nHs to several hundred nHs.

In the predetermined embodiment, the first radiator 122 and the second radiator 123 which are included in the embedded antenna 120 may be formed of a conductive metal such as copper or an alloy of copper and nickel, and may be installed on a surface of a carrier injected with a plastic material (e.g., polycarbonate). Further, the first radiator 122 and the second radiator 123 may be formed on the PCB 114 as an integrated structure.

Figure 3:
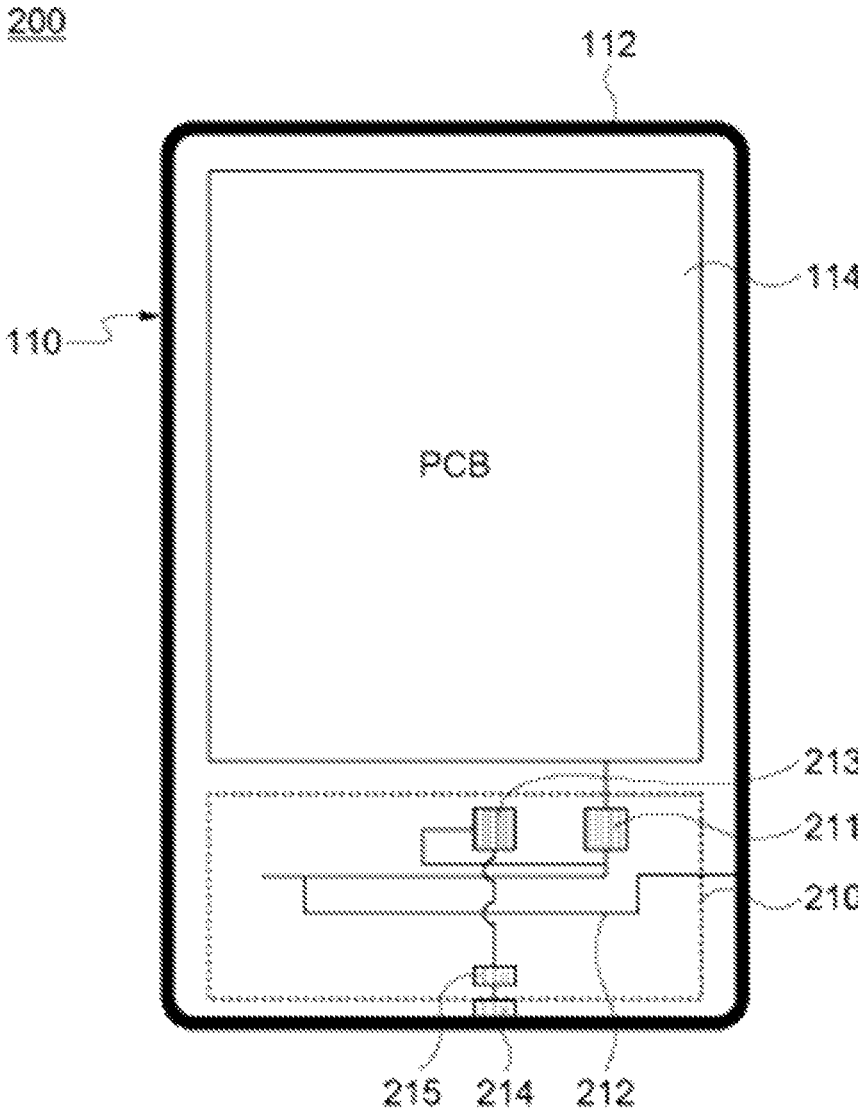
FIG. 3 is a view illustrating a mobile terminal including an embedded antenna according to another embodiment of the present invention.
Figure 4:
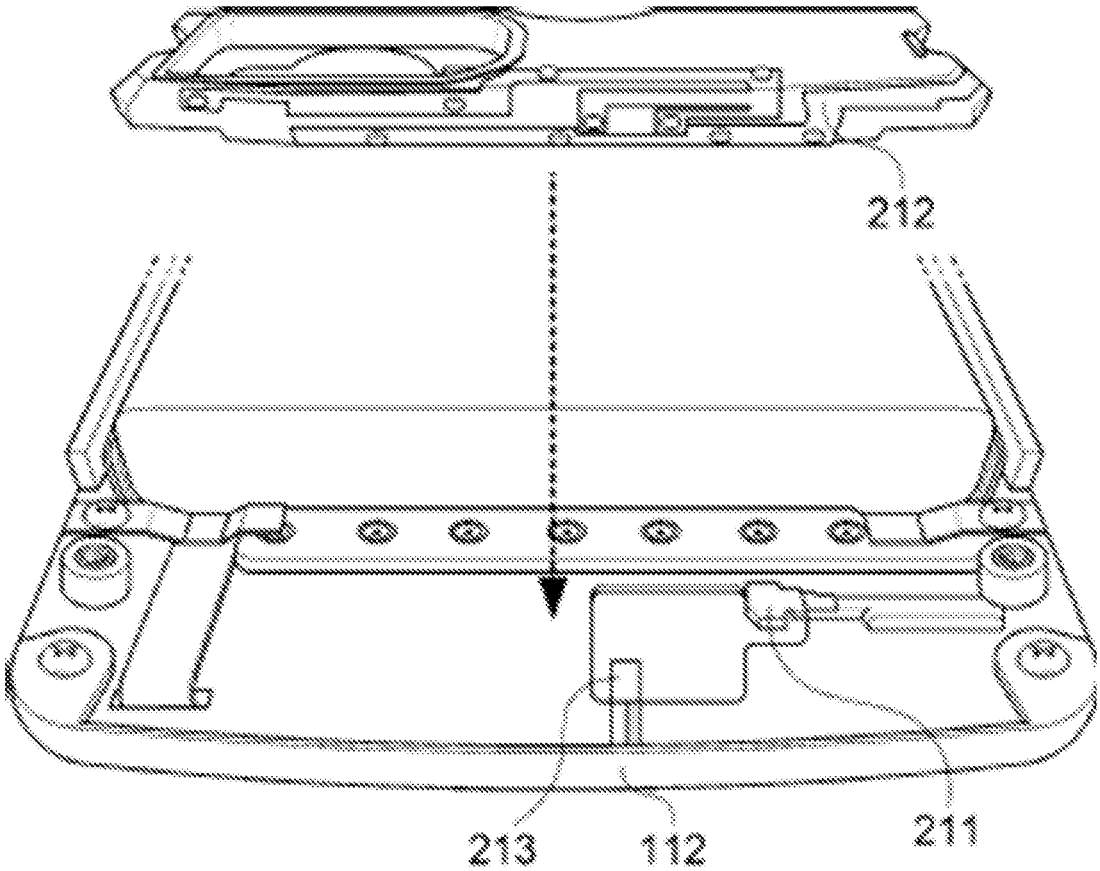
FIG. 4 is a view illustrating an internal structure of a mobile terminal on which an embedded antenna according to another embodiment of the present invention is mounted.

FIG. 3 is a view illustrating a mobile terminal including an embedded antenna according to another embodiment of the present invention, and FIG. 4 is a view illustrating an internal structure of a mobile terminal on which the embedded antenna according to another embodiment of the present invention is mounted.

Before the mobile terminal is described, since the same functions as or similar functions to the components in one embodiment of the present invention, which are described with reference to FIG. 1, are performed, more detailed descriptions thereof will be omitted.

As illustrated in FIGS. 3 and 4, a mobile terminal 200 according to another embodiment of the present invention includes a main body 110 including an outer edge 112 having a metal material and a PCB 114, and an embedded antenna 210.

Further, the mobile terminal 200 according to another embodiment of the present invention includes the outer edge 112 including a ground pad 214, the PCB 114 mounted inside the main body 110, and the embedded antenna 210.

Meanwhile, the embedded antenna 210 according to another embodiment of the present invention includes a power supply pad 211, a radiator 212 which may process signal in a high-frequency band and a low-frequency band, and a connection pad 213 to which the radiator 212 is connected. Further, the embedded antenna 210 is connected to the ground pad 214 of the outer edge 112 through the connection pad 213.

The radiator 212 may process signals in a high-frequency band in which a frequency band is relatively high such as DCS, PCS, WCDMA, and the like, and in a low-frequency band in which a frequency band is relatively low such as GSM. That is, in another embodiment of the present invention, a single radiator 212 may process the signals in the low-frequency and high-frequency bands.

The above radiator 212 may be connected to the PCB 114 through the power supply pad 211 and to the ground pad 214 through the connection pad 213.

The connection pad 213 may connect the radiator 212 to the outer edge 112. Specifically, the connection pad 213 may be grounded by connecting the radiator 212 to the ground pad 214 formed on the outer edge 112. Accordingly, a ground area of the embedded antenna 210 is increased, and thus a radiation characteristic of a service band having a relatively low-frequency band may be improved.

Further, the ground pad 214 may be formed on the outer edge 112 and connected to the radiator 212 through the connection pad 213 of the embedded antenna 210. As shown in FIG. 3, a branch of the radiator 212 may also be directly connected to the outer edge 112.

Meanwhile, a matching device 215 may be further included between the connection pad 213 and the ground pad 214. A capacitor or an inductor may be used as the matching device 215 as described in FIG. 1.

As described above, in another embodiment of the present invention, since the ground pad 214 is formed on the outer edge 112, a carrier-type radiator 212 of the embedded antenna 210 may be formed separately from the outer edge 112. Accordingly, since the embedded antenna 210 is spaced apart from a user's hand when the mobile terminal 200 is gripped, a hand effect may be reduced.

Figure 5:
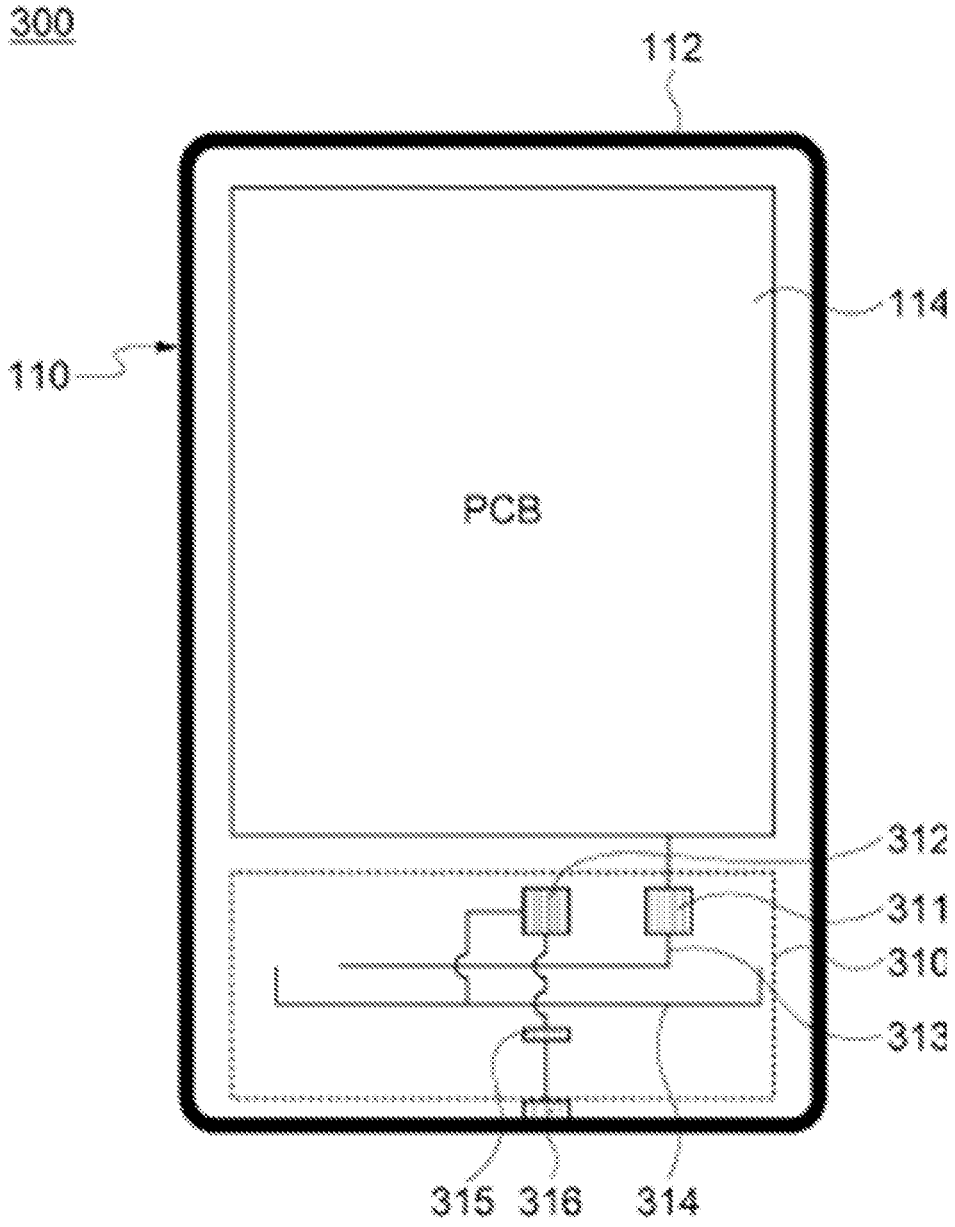
FIG. 5 is a view illustrating a mobile terminal including an embedded antenna according to still another embodiment of the present invention.
Figure 6:
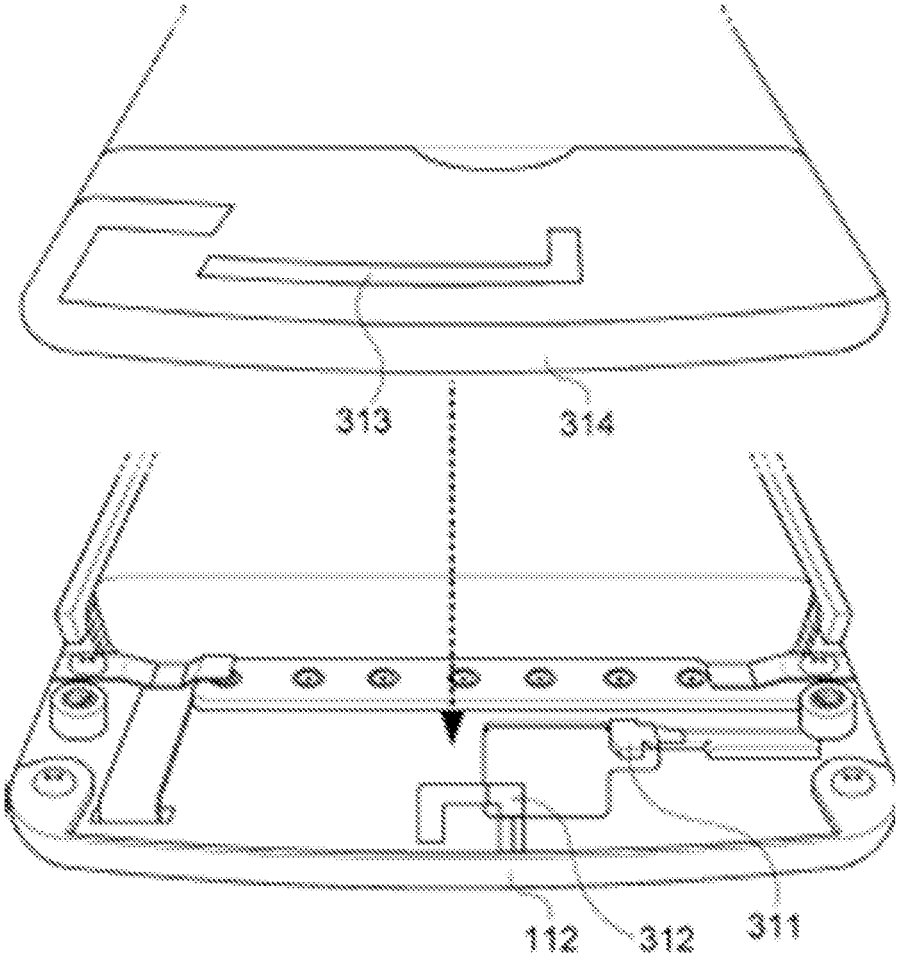
FIG. 6 is a view illustrating an internal structure of a mobile terminal on which an embedded antenna according to still another embodiment of the present invention is mounted.

FIG. 5 is a view illustrating a mobile terminal including an embedded antenna according to still another embodiment of the present invention, and FIG. 6 is a view illustrating an internal structure of a mobile terminal on which the embedded antenna according to still another embodiment of the present invention is mounted.

Before the mobile terminal is described, since the same functions as or similar functions to the components in the embodiments of the present invention, which are described with reference to FIGS. 1 to 4, are performed, more detailed descriptions thereof will be omitted.

As illustrated in FIGS. 5 and 6, a mobile terminal 300 according to still another embodiment of the present invention includes a main body 110 and an embedded antenna 310 as in FIG. 2.

Further, the embedded antenna 310 according to still another embodiment of the present invention includes a power supply pad 311, a connection pad 312, a third radiator 313, a fourth radiator 314, and a matching device 315.

The power supply pad 311 electrically connects a PCB 114 of the main body 110 to the embedded antenna 310. Specifically, the power supply pad 311 may be connected to a duplexer (not illustrated) installed on the PCB 114. Further, the power supply pad 311 may be connected to the third radiator 313.

The third radiator 313 may provide a path through which a current supplied from the PCB 114 flows, and may adjust a resonant frequency in a high-frequency band by adjusting a length of the current path, that is, a length of the third radiator 313.

The fourth radiator 314 may be connected to a ground pad 316 formed on an outer edge 112 through the connection pad 312, and thus may process a signal in a low-frequency band. Here, as a physical length of the fourth radiator 314 is adjusted, a resonant frequency in the low-frequency band may be adjusted.

As described above, as the fourth radiator 314 is connected to the ground pad 316 of the outer edge 112 through the connection pad 312, a ground area of the embedded antenna 310 is increased, and thus the outer edge 112 may improve a radiation characteristic of a service band having a relatively low-frequency band.

Meanwhile, the matching device 315 may be installed between the ground pad 316 and the connection pad 312.

While the present invention has been described above in detail with reference to representative embodiments, it may be understood by those skilled in the art that the embodiment may be variously modified without departing from the scope of the present invention. Therefore, the scope of the present invention is defined not by the described embodiment but by the appended claims, and encompasses equivalents that fall within the scope of the appended claims.

The invention claimed is:

1. An embedded antenna comprising:

a power supply pad connected to a circuit inside a mobile terminal having a metal exterior;

a ground pad formed on the metal exterior;

a connection pad connected to the ground pad, the connection pad spaced apart from the metal exterior and connected to the metal exterior indirectly via the ground pad; and a radiator configured to radiate a signal applied through the power supply pad, the power supply pad directly connecting the radiator to the circuit;

a plastic carrier on a surface of which the radiator is installed, wherein the metal exterior is continuously formed along a whole outer edge of the mobile terminal to perform a ground function of the embedded antenna;

the connection pad and the radiator are positioned within the metal exterior; and the ground pad is formed on an inner surface of the metal exterior, wherein the radiator is directly connected to the power supply pad, the connection pad, and the metal exterior.

2. The embedded antenna of claim 1, further comprising a matching device connected between the connection pad and the ground pad.

3. The embedded antenna of claim 2, wherein the matching device is a capacitor.

4. The embedded antenna of claim 1, wherein the radiator is a single radiator processing signals in a first passband and a second passband different from the first passband.

5. A mobile terminal comprising a main body comprised of the outer edge and the circuit being a printed circuit board, and the embedded antenna of claim 1, wherein the embedded antenna is spaced apart from the outer edge to reduce a hand effect.

6. The embedded antenna of claim 2, the radiator being connected to the connection pad and being spaced apart from the metal exterior by the connection pad, the matching device and the ground pad.

7. The embedded antenna of claim 6, the matching device being a capacitor having a capacitance in the range of several picofarads to several hundred picofarads.

8. The embedded antenna of claim 2, wherein the metal exterior, the ground pad, the matching device, the connection pad and the radiator are electrically connected in series.

9. The embedded antenna of claim 2, wherein the matching device is interposed between the metal exterior and the radiator, the radiator is electrically spaced-apart from the metal exterior by each of the connection pad, the matching device and the connection pad to reduce a hand effect.

10. An antenna arrangement embedded in mobile terminal having a metallic exterior and a printed circuit board within the metallic exterior and having a circuit, the antenna arrangement comprising:

a power supply pad electrically connected to the printed circuit board to receive a signal from the printed circuit board, a first radiator arranged within the metallic exterior and connected to the power supply pad, the first radiator to radiate the signal supplied by the printed circuit board in a first passband, the power supply pad directly connecting the first radiator to the circuit, a plastic carrier on a surface of which the first radiator is arranged, a ground pad arranged on an inner surface of the metallic exterior, and a connection pad arranged within the metallic exterior and connected to the ground pad, the connection pad spaced apart from the metallic exterior and connected to the metal exterior indirectly via the ground pad, wherein the metallic exterior being continuously formed along a whole outer edge of the mobile terminal to perform a ground function of the antenna arrangement, wherein the first radiator is directly connected to the power supply pad, the connection pad, and the metallic exterior.

11. The antenna arrangement of claim 10, further comprising a matching device electrically interposed between the first radiator and the metallic exterior to increase a spacing between the metallic exterior and the first radiator to reduce a hand effect.

12. The antenna arrangement of claim 10, wherein the first radiator being connected to the connection pad and being an only radiator within the antenna arrangement and radiating signals of both a first and a second and different bandpass.

13. The antenna arrangement of claim 12, the first radiator, the connection pad, the ground pad and the metallic exterior being electrically connected in series, the first radiator being spaced apart from the metallic exterior by each of the connection pad and the ground pad to reduce a hand effect.

* * * * *